United States Patent [19]

Renner et al.

[11] Patent Number: 4,977,072

[45] Date of Patent: Dec. 11, 1990

[54] COLOR PHOTOGRAPHIC RECORDING MATERIAL CONTAINING COLOR COUPLERS

[75] Inventors: Günter Renner, Bergisch Gladbach; Reinhart Matejec, Leverkusen, both of Fed. Rep. of Germany

[73] Assignee: Agfa-Gevaert Aktiengesellschaft, Leverkusen, Fed. Rep. of Germany

[21] Appl. No.: 214,895

[22] Filed: Jun. 29, 1988

Related U.S. Application Data

[63] Continuation of Ser. No. 931,450, Nov. 17, 1986, abandoned.

[30] Foreign Application Priority Data

Nov. 27, 1985 [DE] Fed. Rep. of Germany ..... 3541858

[51] Int. Cl.[5] ..... G03C 7/333; G03C 7/38; G03C 7/384

[52] U.S. Cl. ..... 430/549; 430/359; 430/504; 430/506; 430/554; 430/555; 430/558

[58] Field of Search ..... 430/551, 504, 505, 506, 430/549, 359, 558, 555, 554

[56] References Cited

U.S. PATENT DOCUMENTS

| | | | |
|---|---|---|---|
| 3,476,560 | 11/1969 | Yasuda | 430/549 |
| 3,790,379 | 2/1974 | Oishi et al. | 430/549 |
| 4,029,503 | 7/1977 | Fujiwhara et al. | 430/226 |
| 4,070,191 | 1/1978 | Imamura et al. | 430/555 |
| 4,489,155 | 12/1984 | Sakanoue et al. | 430/549 |
| 4,536,472 | 8/1985 | Kato et al. | 430/505 |
| 4,618,573 | 10/1986 | Okamura et al. | 430/558 |
| 4,647,527 | 3/1987 | Ikenoue et al. | 430/505 |
| 4,690,888 | 9/1987 | Fujiwhara et al. | 430/549 |

FOREIGN PATENT DOCUMENTS 128433 9/1985 Japan .

OTHER PUBLICATIONS

J60/128433, 9/7/85, partial English language translation.

*Primary Examiner*—Paul R. Michl
*Assistant Examiner*—Lee C. Wright
*Attorney, Agent, or Firm*—Connolly & Hutz

[57] ABSTRACT

Improved color graininess can be obtained with a color photographic recording material containing in association with a silver halide emulsion layer unit a non-diffusing colored color coupler which, in the coupling position, contains a diffusion-proofing primary ballast group which is attached through an azo group and which is releasable during the color coupling reaction and which coupler gives a hydrophobic dye of limited mobility in the color coupling reaction.

7 Claims, No Drawings

COLOR PHOTOGRAPHIC RECORDING MATERIAL CONTAINING COLOR COUPLERS

This application is a continuation of application Ser. No. 931,450 filed Nov. 17, 1986, now abandoned.

This invention relates to a color-corrected color photographic recording material comprising at least one silver halide emulsion layer unit with which a non-diffusing colorless color coupler and a non-diffusing colored color coupler are associated; in the color coupling reaction, the non-diffusing colored color coupler gives a hydrophobic dye of limited mobility.

It is known that colored photographic images can be produced by chromogenic development, i.e. by developing silver halide emulsion layers which have been exposed imagewise in the presence of suitable color couplers using suitable color-forming developer compounds (so-called color developers), the oxidation product of the developer compounds formed in consistency with the silver image reacting with the color coupler to form a dye image. Aromatic compounds containing primary amino groups, particularly those of the p-phenylenediamine type, are normally used as color developers.

In practice, both the color couplers and the dyes obtained therefrom by chromogenic development have to satisfy numerous requirements. Thus, the coupling velocity of the color couplers with the oxidation product of the color developer should be as high as possible and a very high maximum color density should be able to be obtained. The color couplers and the dyes obtained therefrom have to be sufficiently stable to light, elevated temperature and moisture. This applies both to fresh material and also to processed material. For example, the residual coupler still present in the image white areas of the processed material should not yellow. In addition, the dyes should be sufficiently resistant to gaseous reducing or oxidizing agents. They should also be anchored in non-diffusing form in the image layer and should be deposited as an extremely fine grain during chromogenic development. Finally, the dyes formed from the color couplers during chromogenic development should show a favorable absorption curve with a maximum which corresponds to the color of the particular component image required and with minimal secondary absorptions. Thus, in the ideal case for example, a magenta dye should absorb green light almost completely while allowing through blue and red light.

The image dyes produced by chromogenic development do not entirely satisfy this requirement. In addition to the desired primary absorption, they generally show considerable, undesired secondary absorptions in the other spectral regions. The undesired secondary densities can be at least partly masked by using suitable colored masking couplers which lose their color during chromogenic development and recouple to form the desired image dyes. This color correction principle is described, for example, in US-A-2 428 054 and in US-A-2 449 966. Suitable masking couplers not only show high coupling activity, they also meet the demands made of them in spectral terms. In the case of the magenta couplers for example, this means that the natural yellow color of the masking couplers in question is extremely well adapted to the yellow secondary density to be masked and that the dye produced during the coupling reaction absorbs primarily in the green spectral region and minimally in the other spectral regions (blue, red).

In order to obtain high photographic sensitivity, silver halide emulsions of which the silver halide grains are comparatively large are generally used. The result of this is that a relatively coarse-grained color image is formed. Accordingly, there is interest in highly sensitive color-corrected recording materials showing improved color graininess. This applies in particular to the magenta layers because the human eye is at its most sensitive and, hence, at its most perceptive for color graininess in the green spectral region.

One known measure for improving color graininess is to use non-diffusing color couplers which form a dye of limited mobility or a soluble dye during the color coupling reaction (DE-A-31 35 938, EP-A-0 109 831). Where a soluble dye is formed, a mordant also has to be present in the recording material to prevent the dye from being washed out of the recording material by the alkaline processing baths. In many cases, the reduction in colored graininess also leads to a reduction in the sharpness of the image produced in the layer.

The object of the present invention is to provide a color-corrected color photographic recording material which shows high sensitivity and improved color graininess without any reduction in sharpness.

Accordingly, the present invention relates to a color photographic recording material comprising at least one silver halide emulsion layer unit and at least two non-diffusing color couplers, one colorless and the other colored, associated with the silver halide emulsion layer unit, characterized in that, in the coupling position, the colored, non-diffusing color coupler contains a diffusion-proofing primary ballast group releasable during the color coupling reaction and optionally, in non-coupling positions, one or more secondary ballast groups so that a hydrophobic dye of limited mobility is formed during the color coupling reaction.

According to the invention, therefore, the color photographic recording material contains at least one non-diffusing colorless color coupler and at least one non-diffusing colored color coupler in spatial and spectral association with at least one silver halide emulsion layer unit. The colorless color coupler gives a non-diffusing or weakly diffusing dye during chromogenic development while the colored color coupler gives a weakly diffusing dye. The weakly diffusing dye shows limited mobility, at least under the chromogenic development conditions, in he layers of the color photographic recording material. This results in controlled blending of the dye clouds formed, creating the impression of reduced color graininess. On the other hand, the mobility of the dye formed should not be too great because otherwise sharpness is lastingly impaired and the image contours are completely blurred or the dye is completely dissolved out of the layers. Accordingly, the dye should be hydrophobic and as far as possible should not contain any alkali-solubilizing groups.

The non-diffusing colored color couplers used in accordance with the invention have their own color and resistance to diffusion by virtue of the presence of a primary ballast group attached to the coupling position of the color couplers and corresponding to the following formula

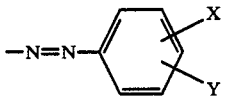

in which

X represents one, two or three like or different organic groups attached directly or through —O—, —S—, —NH—CO— or —NH—$SO_2$—, of which the overall size is sufficient to impart the necessary diffusion resistance to the color coupler. The organic groups are preferably alkyl groups which together contain in all at least 8 carbon atoms and which may be linear or branched and optionally substituted, for example by halogen, —OH, alkoxy, aroxy, alkylthio or aryl (benzyl);

Y represents hydrogen, halogen, for example Cl or Br, or —OH.

The non-diffusing colored color couplers according to the invention are preferably those which form a magenta dye and which are naturally yellow in color. Examples of non-diffusing colored color couplers such as these are characterized by the following general formula:

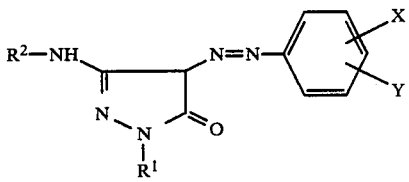

I in which

X and Y are as defined above and $R^1$ represents alkyl, aralkyl or aryl;

$R^2$ represents aryl or acyl;

the groups represented by $R^1$ and $R^2$ being such that they impart limited mobility to the magenta dye formed. The groups $R^1$ and $R^2$ preferably contain together no more than 19 carbon atoms. In addition, they contain no alkali-solubilizing groups.

However, the greatest preference is attributed to colored magenta couplers corresponding to the following formula

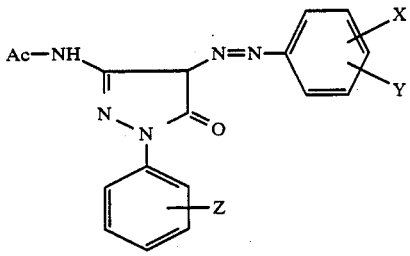

II in which X and Y are as defined above and

Ac is an acyl group containing in all at most 9 carbon atoms, the acyl group being derived from an aliphatic or aromatic carboxylic or sulfonic acid, a carbamic or sulfamic acid or a carbonic acid monoester; and Z represents hydrogen or one or more substituents selected from the group comprising halogen, alkyl, alkoxy, alkylthio, acylamino, alkylsulfonyl and sulfamoyl, the substituents mentioned together containing in all no more than 5 carbon atoms.

The acyl group Ac, for example where it is an alkylcarbonyl or benzoyl group, may optionally be substituted, for example by halogen, —OH, alkoxy, aroxy or acylamino, but with the proviso that the total number of carbon atoms in the acyl group, including these substituents, does not exceed 9 and that the substituents in question never contain an alkali-solubilizing group, such as a carboxy or sulfo group. This second proviso also applies to the substituents Z. In addition, the groups represented by Ac and Z together preferably contain in all from 2 to at most 13 carbon atoms.

The following are examples of the non-diffusing, colored color couplers according to the invention:

1.

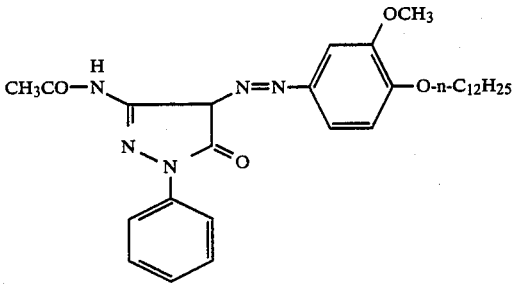

2.

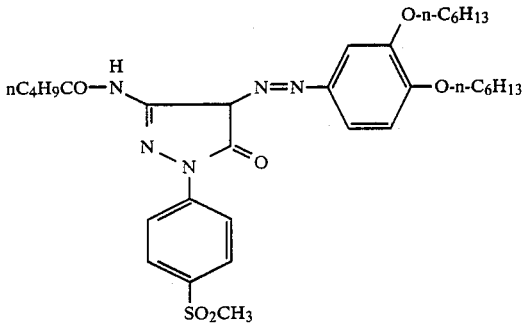

-continued
3.
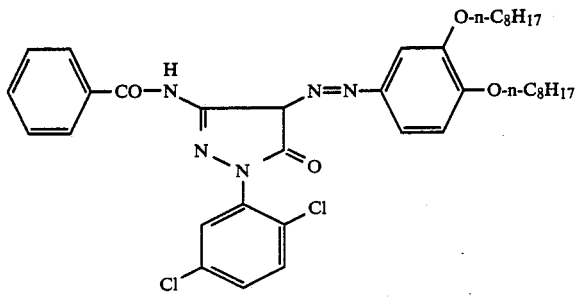
4.
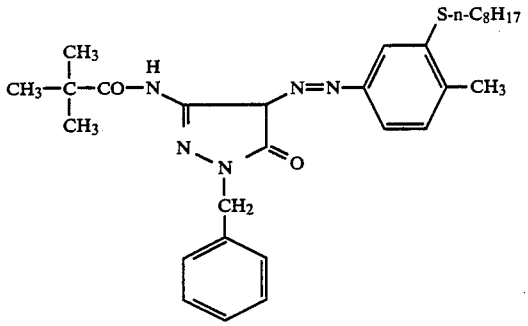
5.
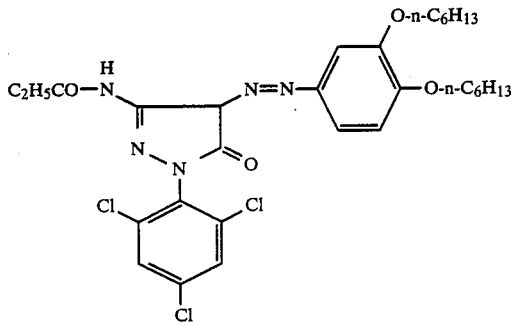
6.
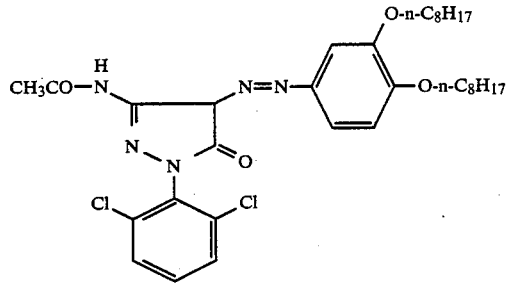
7.
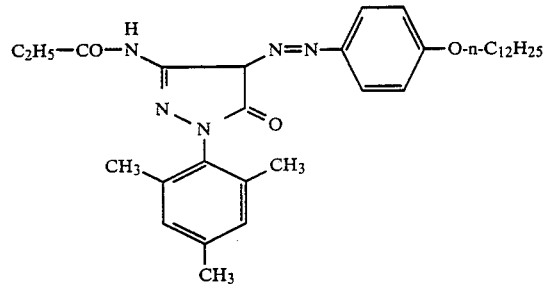

-continued
8.
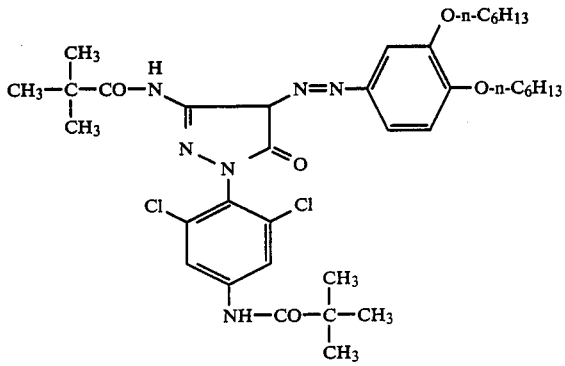
9.
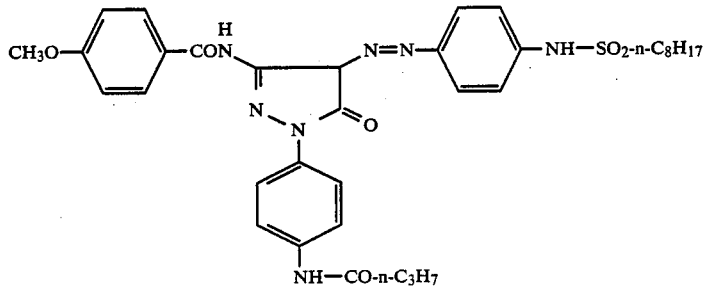
10.
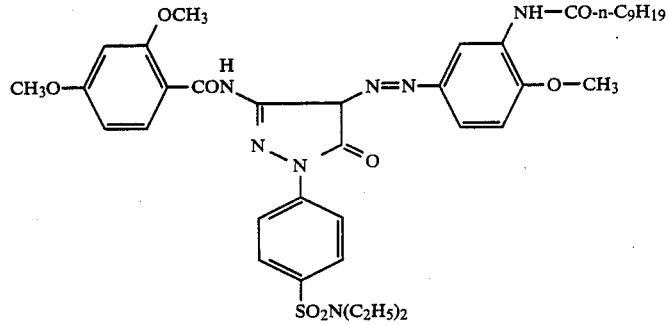
11.
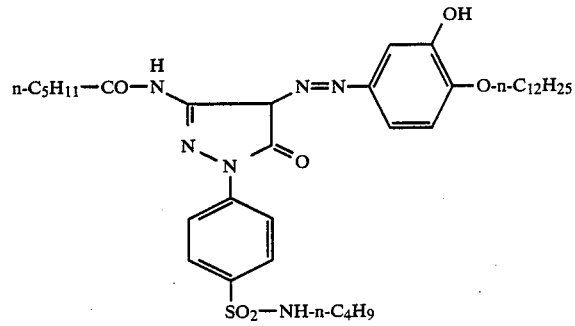
12.
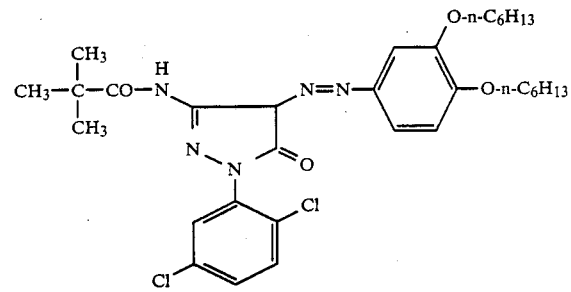

-continued
13.
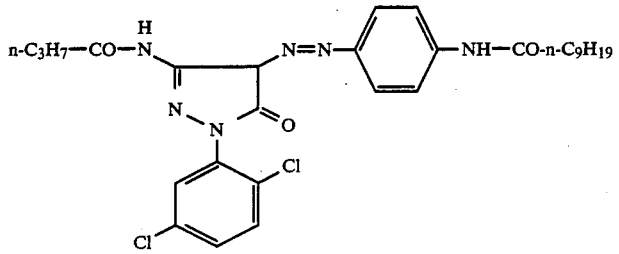
14.
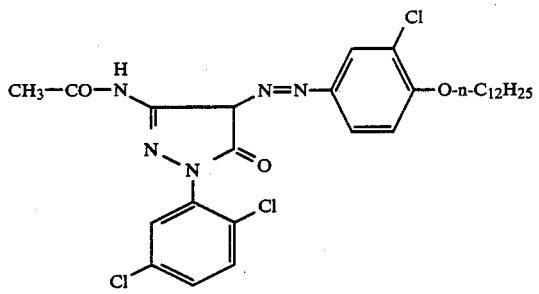
15.
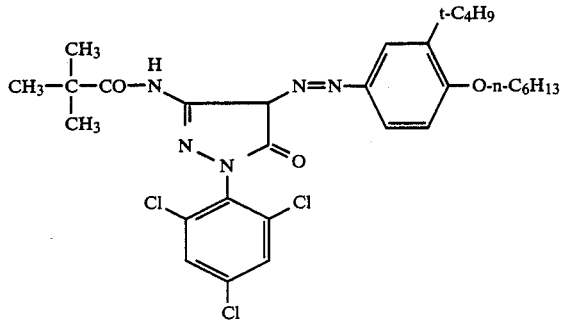
16.
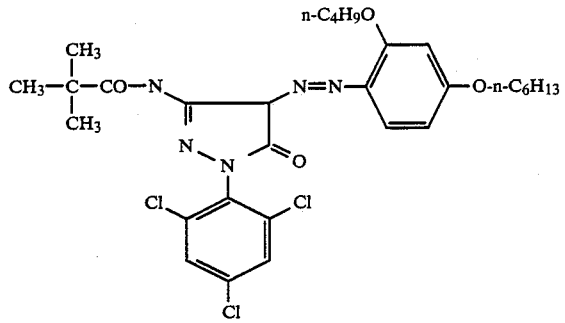
17.
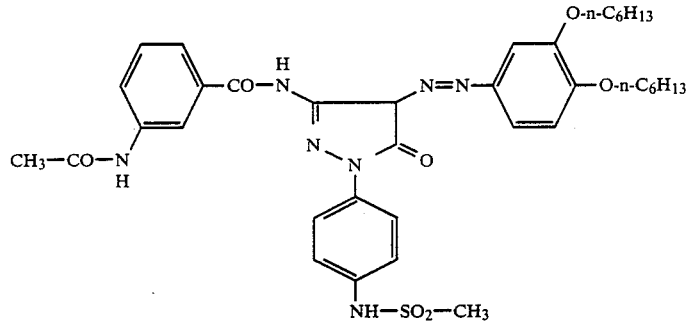

-continued
18.
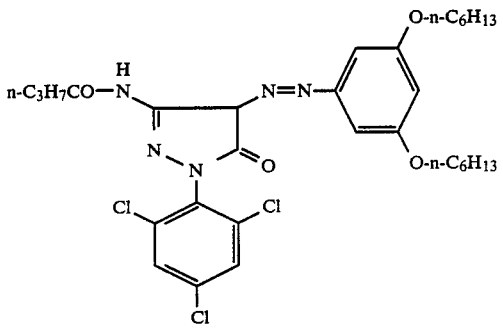
19.
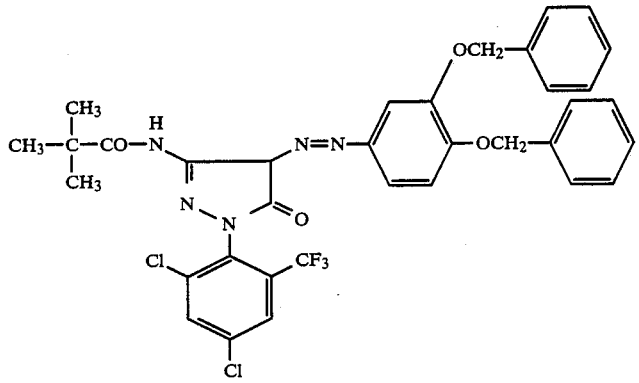
20.
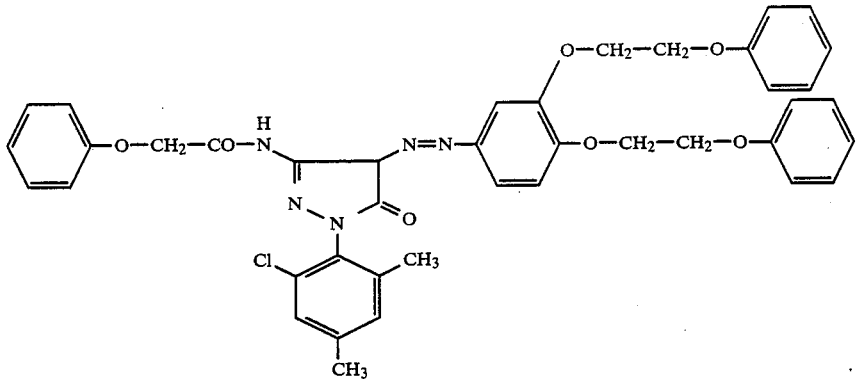
21.
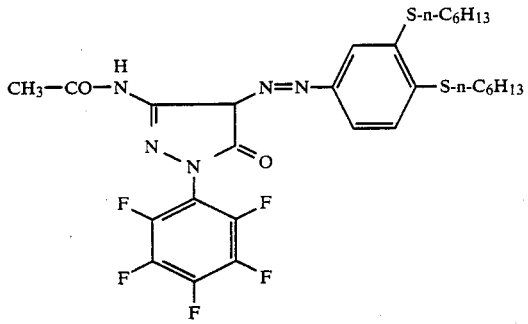

-continued

22.

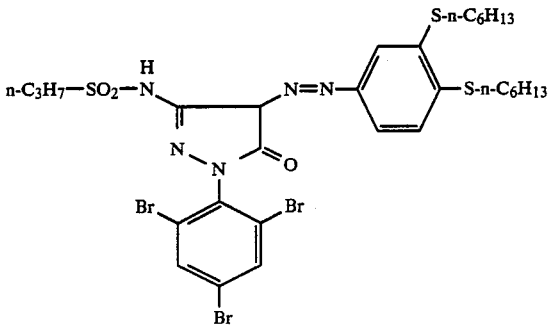

23.

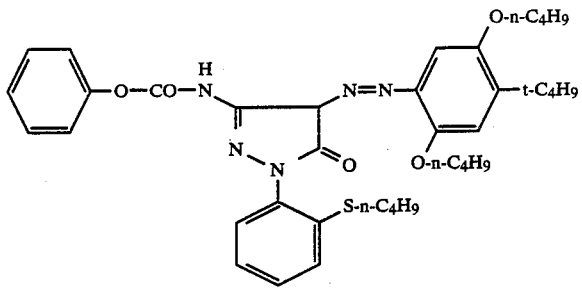

24.

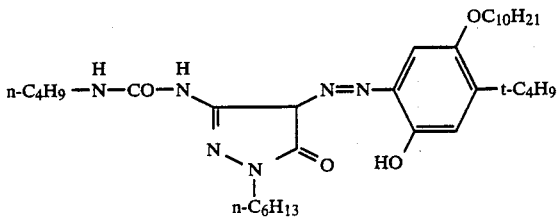

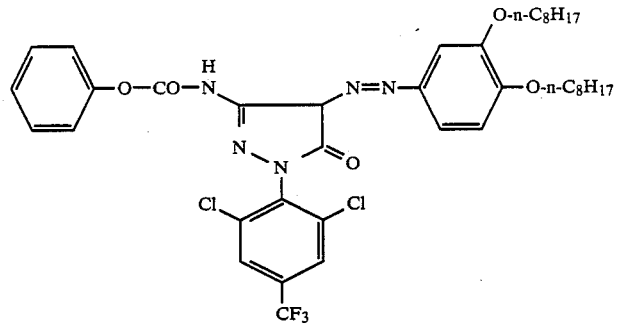

In principle, the colored color couplers according to the invention may be synthesized by known methods. 1. The pyrazolone 4-equivalent couplers may be synthesized, for example, in accordance with US-A-2 600 788. In this case, it is merely important to ensure that the substituents in question ($R^1$, $R^2$ or Z, Ac) are selected according to the requirements of the present invention. 2. The synthesis of the colored couplers from the pyrazolone 4-equivalent couplers according to 1. may be carried out in a known manner by azo coupling, for example in accordance with DE-A-1 797 083, US-A-2 983 608 or German Patent Application No. P 35 30 357.3. In this case, it is merely important to ensure that the aniline used for the diazotization and azo coupling is selected according to the requirements of the general formula I or II.

PREPARATION OF COMPOUND 12

1. Pyrocatechol di-n-hexylether 19.5 g pyrocatechol and 58 g hexylbromide were heated to reflux in 100 ml n-propanol. 63 ml 1 30% sodium methylate solution were added dropwise over a period of 1 hour, followed by heating for another 3 hours with slight distillation of ethanol. The reaction mixture was then poured onto ice, extracted, washed and concentrated.

Yield: 45.1 g (93% of the theoretical)

2. 3-Nitropyrocatechol di-n-hexylether 45.1 g of the compound obtained as described in 1. were added dropwise at a constant temperature of 60° C. to 27 ml 65% nitric acid and 37 ml water. After stirring for 1 hour, the reaction mixture was poured onto ice and the crystals precipitated were filtered off under suction. The product was recrystallized from 200 ml methanol. Yield: 40.3 g=77% of the theoretical.

3. Aminopyrocatechol di-n-hexylether 40.3 g of the product obtained as described in 2. were hydrogenated with Raney nickel in 130 ml ethanol at 40°–50° C. / 20 bar $H_2$-pressure. Hydrochloric acid was added and the aniline hydrochloride was isolated.

4.1-(2,5-dichlorophenyl)-3-pivaloylamino-5-pyrazolone 72 g 1-(2,5-dichlorophenyl)-3-amino-5-pyrazolone and 36 g pivaloyl chloride were stirred into 250 ml dimethylacetamide at 50° C. After brief heating to 90° C., the reaction mixture was cooled and poured while stirring onto ice/hydrochloric acid. The crude product was washed with water, dried and dissolved in and allowed to crystallize from methanol. Pure product was obtained in a yield of 64 g (66% of the theoretical).

5. Compound 12

33 g of the product obtained as described in 3. were suspended in 400 ml ethanol and 10 ml concentrated hydrochloric acid. 7.6 g sodium nitrite in 12 ml water were then slowly added at 0°–5° C. The diazonium salt thus obtained is added dropwise at 10°–15° C. to a solution of 33 g of the product obtained as described in 4. in 500 ml pyridine. The reaction mixture was then stirred for 1 hour at room temperature and poured while stirring into water, followed by decantation, washing and drying. The product could be dissolved in and crystallized from acetonitrile.

Yield: 43 g=68% of the theoretical; Mp. 122°–124° C.

The non-diffusing, colorless color couplers according to the invention are standard color couplers which may be used in the form of 4-equivalent couplers or 2-equivalent couplers. They are preferably hydrophobic couplers which contain in the coupling and/or non-coupling position at least one ballast group which improves solubility in organic solvents and which helps in enabling the couplers to be able to be incorporated in diffusion-resistant form in the layers of the color photographic recording material. The image dye produced from color couplers such as these during chromogenic development is resistant to diffusion or may have limited mobility in the same way as the image dye produced from the colored couplers. The colorless coupler is spectrally adapted to the colored color coupler, i.e. in regard to the color of the image dye produced therefrom. If, for example, a colored color coupler of formula I or formula II is used, the colorless color coupler in question is a magenta coupler, preferably a coupler corresponding to one of general formulae III, IV and V:

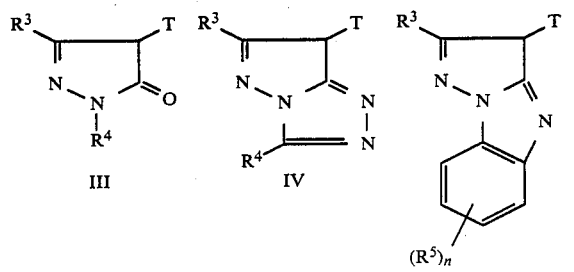

III IV V in which $R^3$ represents alkyl, aryl or an amino group, including a cyclic amino group, optionally substituted by alkyl, aryl or acyl;

$R^4$ represents alkyl, aralkyl or aryl;

$R^5$ represents halogen, alkyl, alkoxy, aroxy, amino, acylamino, carbamoyl, sulfamoyl, alkylsulfonyl;

n=1 to 4;

T represents hydrogen or a group removable during the color coupling reaction;

the substituents $R^3$ or T or $R^4$ (formulae III and IV) and $R^3$ or T or $R^5$ (formula V) having such a size and configuration, either on their own or together, that the color coupler may be incorporated in diffusion-resistant form in the layers of the color photographic recording material However, the dye formed during the color coupling reaction (after the elimination of T) may show weak mobility.

In the context of the invention, weak or limited mobility is understood to be mobility which is guaged so that the contours of the discrete dye patches formed during chromogenic development blend and merge with one another. This degree of mobility is meant to be distinguished on the one hand from the normal situation of total immobility in photographic layers which is desired in conventional photographic recording materials for the color couplers or rather from the dyes produced therefrom in order to obtain extreme sharpness and, on the other hand, from the situation of complete mobility of the dyes, as sought for example in dye diffusion processes. The last-mentioned dyes generally have at least one group which makes them soluble in an alkaline medium. The degree of weak mobility sought in accordance with the invention may be controlled by variation of the substituents, for example the substituents $R^1$, $R^2$, in order specifically to influence for example solubility in the organic medium of the oil former or affinity for the binder matrix.

Color photographic recording materials normally contain at least one silver halide emulsion layer unit for recording light of each of the three spectral regions red, green and blue. To this end, the photosensitive layers are spectrally sensitized in a known manner by suitable sensitizing dyes. Blue-sensitive silver halide emulsion layers do not necessarily have to contain a spectral sensitizer because, in many cases, the natural sensitivity of the silver halide is sufficient for recording blue light.

Each of the photosensitive silver halide emulsion layer units mentioned may consist of a single layer or in a known manner, as for example in the so-called double layer arrangement, may even comprise two or even more partial silver halide emulsion layers (DE-C-1 121 470). Normally, red-sensitive silver halide emulsion layers are arranged nearer the layer support than green-sensitive silver halide emulsion layers which in turn are arranged nearer than blue-sensitive silver halide emulsion layers, a non-photosensitive yellow filter layer generally being present between green-sensitive layers and blue-sensitive layers. However, other arrangements are also possible. In general, a non-photosensitive intermediate layer which may contain agent for suppressing the defective diffusion of developer oxidation products is arranged between layers of different spectral sensitivity. If other silver halide emulsion layers of the same spectral sensitivity are present, they may be arranged immediately adjacent to one another or in such a way that a photosensitive layer of different spectral sensitivity is situated between them (DE-A-1 958 709, DE-A-2 530 645, DE-A-6 622 922).

Color photographic recording materials for the production of multicolor images normally contain color couplers for producing the cyan, magenta and yellow component color images in spatial and spectral association with the silver halide emulsion layer units of different spectral sensitivity. According to the present invention, a combination of colorless and colored color coupler is associated with at least one of the above-mentioned silver halide emulsion layer units, preferably the green-sensitive silver halide emulsion layer unit, the dye formed from the colored color coupler having limited mobility.

In the context of the invention, spatial association is understood to mean that the color couplers are in such a spatial relationship with the silver halide emulsion layer unit that an interaction is possible whereby the silver image formed during development corresponds imagewise with the color image produced from the color couplers. To achieve this result, the color couplers are generally present in a silver halide emulsion layer itself or in an adjacent, optionally non-photosensitive binder layer. However, the colored color coupler and the colorless color coupler do not necessarily have to be present in the same layer.

Spectral association is understood to mean that the spectral sensitivity of each of the photosensitive silver halide emulsion layers and the color of the component color image produced from the particular spatially associated color coupler bear a certain relationship to one another, a component color image of another color (generally for example the colors cyan, magenta and yellow in that order) being associated with each of the spectral sensitivities (red, green, blue).

One or even more color couplers may be associated with each of the differently spectrally sensitized silver halide emulsion layer units. Where such silver halide emulsion layer units consist of several partial silver halide emulsion layers of the same spectral sensitivity, each of them may contain a color coupler, these color couplers not necessarily having to be identical. They are merely required to give at least substantially the same color during color development, normally a color which is complementary with the color of the light to which the silver halide emulsion layers in question are predominantly sensitive.

In preferred embodiments, therefore, at least one non-diffusing color coupler for producing the cyan component color image, generally a coupler of the phenol or α-naphthol type, is associated with red-sensitive silver halide emulsion layer units. At least one non-diuffusing color coupler for producing the magenta component color image, normally a color coupler of the 5-pyrazolone, pyrazolobenzimidazole or pyrazolotriazole type, is associated with green-sensitive silver halide emulsion layer units. Finally, at least one non-diffusing color coupler for producing the yellow component color image, generally a color coupler containing an open-chain ketomethylene group, is associated with blue-sensitive silver halide emulsion layer units. Color couplers of this type are known in large numbers and are described in numerous patent specifications. Reference is made here for example to the publications "Farbkuppler (Color Couplers)" by W.PELZ in "Mitteilungen aus den Forschungslaboratorien der Agfa, Leverkusen/Munchen", Vol. III, page 111 (1961) and by K. VENKATARMAN in "The Chemistry of Synthetic Dyes", Vol. 4, 341 to 387, Academic Press (1971).

The color couplers may be both standard 4-equivalent couplers and also 2-equivalent couplers in which a smaller quantity of silver halide is required for dye production. It is known that 2-equivalent couplers are derived from 4-equivalent couplers in that they contain in the coupling position a substituent which is eliminated during the coupling reaction. The 2-equivalent couplers include both those which are substantially colorless and also those which, like the colored color couplers according to the present invention, have a bright color of their own which disappears during the color coupling reaction or is replaced by the color of the image dye produced. However, the 2-equivalent couplers also include the known white couplers although they do not give a dye on reaction with color developer oxidation products. 2-Equivalent couplers also include the known DIR-couplers, i.e. couplers which contain in the coupling position a releasable group which is released as a diffusing development inhibitor on reaction with color developer oxidation products. Other photographically active compounds, for example development accelerators or fogging agents, may also be released from couplers such as these during development.

Where the color photographic recording material contains one or more silver halide emulsion layer units which, as described above, consist of several partial silver halide layers of the same spectral sensitivity, these partial layers are preferably arranged in a known manner in such a way that the layer having the lowest sensitivity is situated nearest the layer support while the layer having the highest sensitivity is situated furthest away from the layer support. In this connection, it has also proved to be of particular advantage for the colored color coupler according to the present invention to be present in the partial silver halide emulsion layer of highest sensitivity. In this way, it is possible distinctly to improve color graininess, which is primarily determined by the grain size of the silver halide emulsion in the layers of highest sensitivity, without at the same time significantly impairing image sharpness which is primarily determined by the layers of lower sensitivity. Even if the colorless color coupler present in the partial silver halide emulsion layer of highest sensitivity itself gives a dye of limited mobility, color graininess may be further improved by a non-diffusing colored color coupler according to the present invention also present in the same layer.

In addition to or alternatively to the embodiment described above, the non-diffusing colored color coupler according to the present invention may even be present with advantage in a non-photosensitive intermediate layer arranged between a partial silver halide emulsion layer of relatively high sensitivity and a less sensitive partial silver halide emulsion layer of the same spectral sensitivity. Color graininess may be further improved in this case, too.

Finally, the non-diffusing colored color coupler according to the present invention may also be present in any layers, including intermediate layers of a photosensitive, more especially green-sensitive, silver halide emulsion layer unit.

The non-diffusing colored color coupler used in accordance with the invention may perform a dual function. not only does it have a positive effect upon the color graininess of the color images obtained with the recording material according to the invention, it is also capable of improving color reproduction because, by virtue of its natural color which is lost during chromogenic development or is replaced by the color of the image dye produced, it is capable of completely or partly masking the unwanted secondary products of the image dye. However, if the masking effect is not sufficient for obtaining optimal color reproduction, it is possible additionally to use other masking agents, particularly standard masking couplers.

In addition to the constituents mentioned above, the color photographic recording material according to the present invention may contain other additives, such as for example antioxidants, dye stabilizers and agents for influencing optical, mechanical and electrostatic properties.

Agents such as these may be, for example, optical brighteners, antifogging agents and stabilizers, anti-discolorants, dye stabilizers, light-absorbing and light-scattering agents, hardeners, softeners and lubricants, antistatic agents, matting agents and development modifiers, of the type described for example in Research Disclosure 17 643 (Dec. 1975).

To produce color photographic images, the color photographic recording material according to the invention is developed with a color developer compound. The color developer compound may be any color developer compound which is capable of reacting in the form of its oxidation product with color couplers to form azomethine dyes. Suitable color developer compounds are aromatic compounds containing at least one primary amino group of the p-phenylenediamine type, for example N,N-dialkyl-p-phenylenediamines, such as N,N-diethyl-p-phenylenediamine, 1-(N-ethyl-N-methylsulfonamidoethyl)-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine.

EXAMPLE 1

Six different recording materials A to F were prepared by applying one of the layers 1*a* to 1f specified below to a transparent layer support of cellulose triacetate. The quantities indicated are all based on 1 $m^2$ For the silver halide coating, the corresponding quantity of $AgNO_3$ is shown. A green-sensitized silver bromide iodide emulsion containing 5 mole % iodide and having an average grain diameter of 0.8 μm stabilize1 with 0.5 g 4-hydroxy-6-methyl-1,3,3*a*,7-tetraazaindene per 100 g $AgNO_3$ was used.

Layers 1*a* to 1*f*

2.7 g $AgNO_3$ 0.5 g gelatin 0.75 g magenta coupler K-1 emulsified with tricresylphosphate in a ratio by weight of 1:1

0.2 g masking coupler as indicated below, emulsified with tricresylphosphate in a ratio by weight of 1:1.

The layers 1*a* to 1*f* were coated with a protective layer containing 0.6 g gelatin and 0.3 g of a hardener.

| Layer | Masking coupler |
|---|---|
| 1a | M-1 |
| 1b | M-2 |
| 1c | compound 2 |
| 1d | compound 8 |
| 1e | compound 12 |

-continued

| Layer | Masking coupler |
|---|---|
| 1f | compound 15 |

Magneta coupler K-1

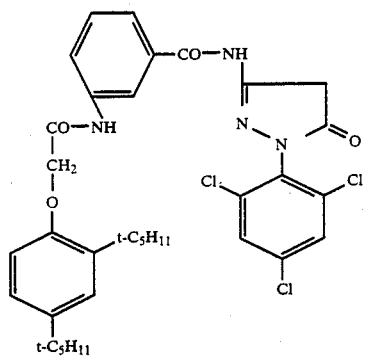

Masking coupler M-1

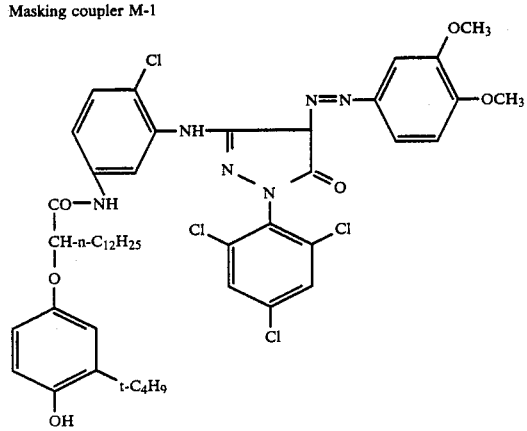

Masking coupler M-2

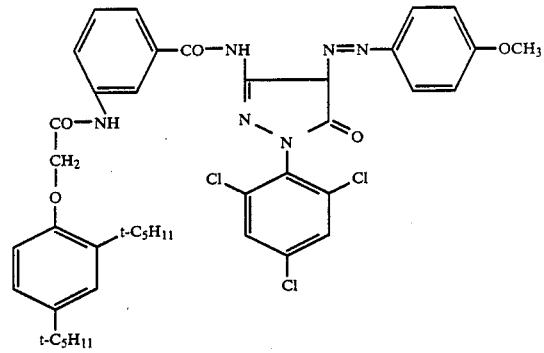

(= coupler B from US-A-2 983 608, column 2)

The six recording materials A to F were exposed to white light behind a continuous wedge and then processed by the color negative method described in "The British Journal of Photography", (1974), pages 597 and 598. Color graininess ($\sigma_D$) was then measured at various color densities by the method described by T.H.James in "The Theory of the Photographic Process", 4th Edition, Macmillan Publ. Co. Inc., New York/London (1977), pages 618–621.

The results are set out in Table I below and show that, for substantially the same sensitivity, a distinctly finer color grain is obtained with the colored color couplers according to the invention than with the masking couplers M-1 and M-2 used for comparison.

TABLE I

| Material | Colored color coupler | Sensitivity | Magenta graininess [$\sigma_D \times 10^2$] D = 0.5 | D = 1.0 | D = 1.5 |
|---|---|---|---|---|---|
| A | M-1 | 27.2 | 2.8 | 3.9 | 3.5 |
| B | M-2 | 27.0 | 2.7 | 3.9 | 3.4 |
| C | comp. 2 | 27.1 | 2.4 | 3.5 | 3.1 |
| D | comp. 8 | 27.2 | 2.4 | 3.4 | 3.0 |
| E | comp. 12 | 26.9 | 2.3 | 3.5 | 3.0 |
| F | comp. 15 | 27.0 | 2.5 | 3.5 | 3.1 |

EXAMPLE 2

Recording materials G to L were prepared with the same silver halide emulsion and with the same masking couplers as in Example 1, the magenta coupler K-1 being replaced by the magenta coupler K-2.

Magenta coupler K-2

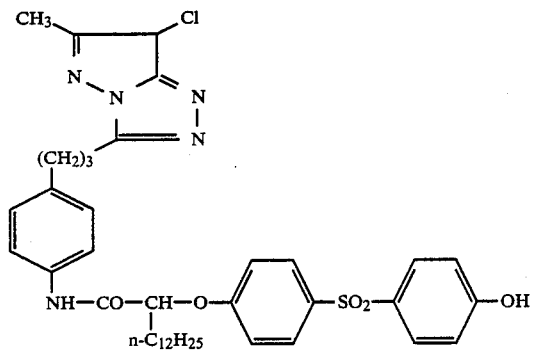

The results are shown in Table II

TABLE II

| Material | Colored color coupler | Sensitivity | Magenta graininess [$\sigma_D \times 10^2$] D = 0.5 | D = 1.0 | D = 1.5 |
|---|---|---|---|---|---|
| G | M-1 | 27.4 | 2.9 | 4.0 | 3.7 |
| H | M-2 | 27.2 | 3.0 | 3.9 | 3.8 |
| I | comp. 2 | 27.2 | 2.5 | 3.6 | 3.2 |
| J | comp. 8 | 27.3 | 2.4 | 3.6 | 3.3 |
| K | comp. 12 | 27.1 | 2.4 | 3.4 | 3.2 |
| L | comp. 15 | 27.1 | 2.5 | 3.6 | 3.1 |

EXAMPLE 3

Four recording materials M to P containing partial magenta components were prepared by applying the following layers to a transparent layer support of cellulose triacetate.

1st layer: (low sensitivity green-sensitized layer)
Silver bromide iodide emulsion of 2.5 g $AgNO_3$ containing 4.5 mole % iodide and having an average grain diameter of 0.4 μm, green-sensitized
0.6 g magenta coupler K-3*

-continued 50 mg masking coupler M-1*
7.5 mg DIR-coupler K-4*
*emulsified with tricresylphosphate in a ratio by weight of 1:1
2nd layer: (intermediate layer; present only in recording materials N and P, but not in M and O)
0.5 g gelatin
35 mg masking coupler: M-1 in material N, comp. 8 in material P.
3rd layer: (high-sensitivity green-sensitized layer)
Silver bromide iodide emulsion of 2.5 g $AgNO_3$ containing 7 mole % iodide and having an average grain diameter of 0.7 μm, green-sensitized
1.4 g gelatin
0.15 g magenta coupler K-3, emulsified with three times the quantity by weight of tricresylphosphate
30 mg masking coupler: M-1 in materials M and N; comp. 8 in materials O and P.
4th layer: (hardening/protective layer)
0.8 g gelatin and 0.5 g of a hardener Magenta coupler K-3

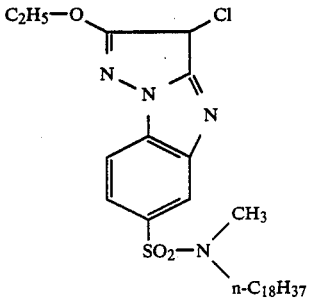

DIR coupler K-4

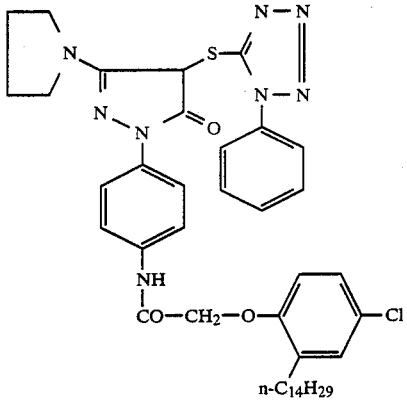

The results (exposure and processing as in Example 1) are shown in Table III.

TABLE III

| Material | Colored color coupler in layer 1 | 2 | 3 | Sensitivity [DIN] | Magenta graininess [$\sigma_D \times 10^2$] D = 0.5 | D = 1.0 | D = 1.5 |
|---|---|---|---|---|---|---|---|
| M | M-1 | none | M-1 | 26.5 | 2.5 | 1.8 | 1.2 |
| N | M-1 | M-1 | M-1 | 26.4 | 2.3 | 1.7 | 1.2 |
| O | M-1 | none | comp. 8 | 26.5 | 2.0 | 1.5 | 1.2 |
| P | M-1 | comp. 8 | comp. 8 | 26.6 | 1.7 | 1.3 | 1.2 |

EXAMPLE 4

Six recording materials Q to V containing red-, green- and blue-sensitive layers (complete structure) were prepared by applying the following layers in the order indicated to a transparent layer support of cellulose triacetate. The quantities indicated are all based on 1 $m^2$. For the silver halide coating, the corresponding quantity of $AgNO_3$ is shown. Silver bromide iodide emulsions stabilized with 0.5 g 4-hydroxy-6-methyl-1,3,3*a*,7-tetraazaindene per 100 g $AgNO_3$ were used.

| | |
|---|---|
| 1st layer: | (antihalo layer)<br>0.33 g Ag (black colloidal silver sol)<br>1.5 g gelatin |
| 2nd layer: | (intermediate layer)<br>0.6 g gelatin |
| 3rd layer: | (low-sensitivity red-sensitized layer)<br>3.0 g $AgNO_3$, 4 mole % iodide, mean grain diameter 0.45 μm, red-sensitized<br>2.0 g gelatin<br>0.6 g colorless cyan coupler K-5*<br>50 mg colored cyan coupler K-6*<br>25 mg DIR-coupler K-7*<br>*emulsified with half the quantity by weight of tricresylphosphate |
| 4th layer: | (highly sensitive red-sensitized layer)<br>2.8 g $AgNO_3$, 8.5 mole % iodide, mean grain diameter 0.8 μm, red-sensitized<br>1.8 g gelatin<br>0.15 g colorless cyan coupler K-8 emulsified with dibutylphthalate in a ratio by weight of 1:1 |
| 5th layer: | (intermediate layer)<br>0.7 g gelatin<br>0.2 g 2,5-diisooctylhydroquinone |
| 6th layer: | (low-sensitivity green-sensitized layer)<br>As first layer of Example 3, but with 0.6 g magenta coupler K-1 instead of 0.6 g magenta coupler K-3 |
| 7th layer | (high-sensitivity green-sensitized layer)<br>As 3rd layer of Example 3, but with the following couplers:<br>0.20 g magenta coupler K-9 emulsified with tricresylphosphate in a ratio by weight of 1:1 (all materials Q to V)<br>30 mg masking coupler as indicated in Example 1 for layers 1a to 1f |
| 8th layer: | (intermediate layer)<br>0.5 g gelatin<br>0.15 g 2,5-diisooctylhydroquinone |
| 9th layer: | (yellow filter layer)<br>0.2 g Ag (yellow colloidal silver sol)<br>0.9 g gelatin |
| 10th layer: | (low-sensitivity blue-sensitive layer)<br>0.6 g $AgNO_3$, 4.9 mole % iodide, average grain diameter 0.45 μm, blue-sensitized<br>0.85 g gelatin<br>0.7 g yellow coupler K-10*<br>0.15 g DIR-coupler K-11*<br>*emulsified with tricresylphosphate in a ratio by weight of 1:1 |
| 11th layer: | (high-sensitivity blue-sensitive layer)<br>1.0 g $AgNO_3$, 9.0 mole % iodide, average grain diameter 0.9 μm, blue-sensitized<br>0.85 g gelatin<br>0.3 g yellow coupler K-10 emulsified with tricresylphosphate in a ratio by weight of 1:1 |
| 12th layer: | (protective layer)<br>0.2 g gelatin<br>0.5 g of a standard US absorber |
| 13th layer: | (hardening layer)<br>1.5 g gelatin<br>0.7 g of a hardener CAS Reg. No. 65411-60-1 |

Colorless cyan coupler K-5

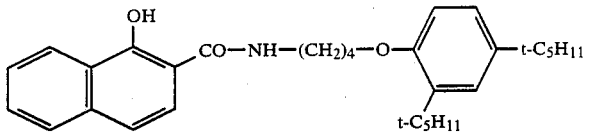

Colored cyan coupler K-6

-continued
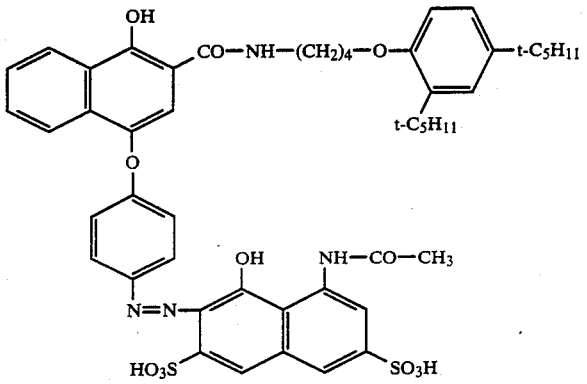
DIR coupler K-7
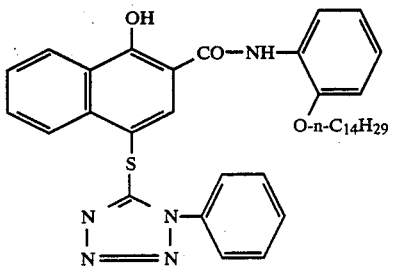
Colorless cyan coupler K-8
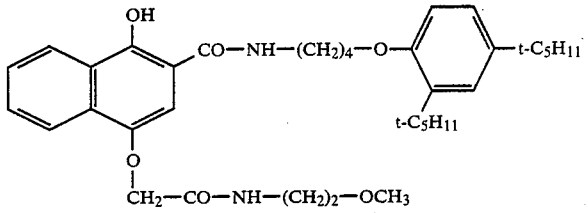
Magenta coupler K-9
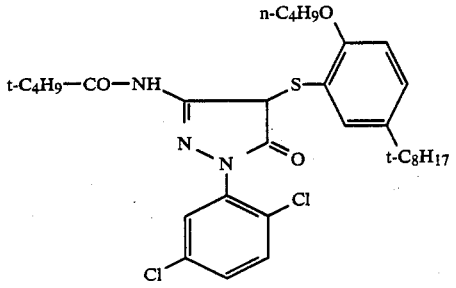
Yellow coupler K-10
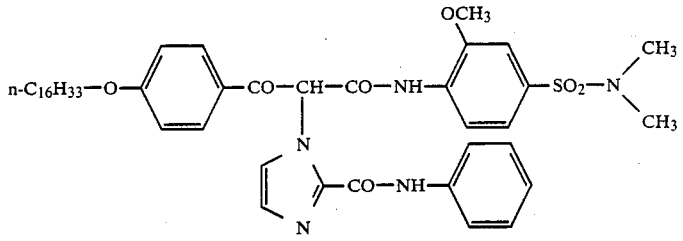
DIR-coupler K-11

-continued

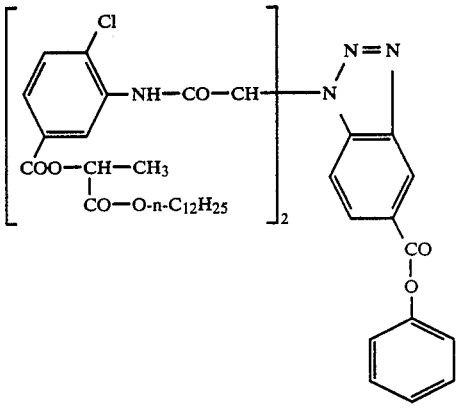

The results (exposure and processing as in Example 1are shown in Table IV

TABLE IV

| Material | colored color coupler | Sensitivity [DIN] | Magenta graininess [$\sigma_D \times 10^2$] D = 0.5 | D = 1.0 | D = 1.5 |
|---|---|---|---|---|---|
| Q | M-1 | 25.2 | 1.3 | 1.2 | 1.1 |
| R | M-2 | 24.9 | 1.2 | 1.1 | 1.1 |
| S | comp. 2 | 25.0 | 0.8 | 1.0 | 1.1 |
| T | comp. 8 | 25.3 | 0.8 | 0.9 | 1.0 |
| U | comp. 12 | 24.8 | 0.7 | 0.9 | 1.1 |
| V | comp. 15 | 25.1 | 0.9 | 1.0 | 1.1 |

We claim:

1. A color photographic recording material comprising at least one silver halide emulsion layer unit and at least two non-diffusing magenta color couplers, one colorless and the other colored, associated with the silver halide emulsion layer unit, wherein the colored non-diffusing color coupler contains, attached to the coupling position, a diffusion-proofing primary ballast group attached through an azo group and being releasable during the color coupling reaction and optionally, in non-coupling positions, one or more secondary ballast groups so that a hydrophobic dye of limited mobility is formed in the color coupling reaction, wherein the colored color coupler is a magenta coupler corresponding to the following formula

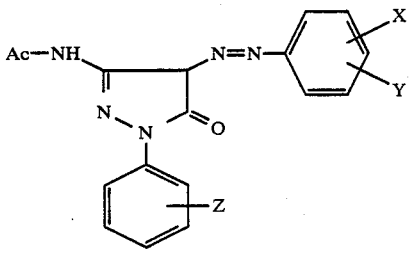

in which

Ac is a acyl group containing in all at most 9 carbon atoms which does not contain an alkali-solubilizing group, the acyl group being derived from an aliphatic or aromatic carboxylic or sulfonic acid, a carbamic acid or a carbonic acid monoester;

represents one, two or three alkyl groups which are attached directly or through —O—, —S—, —N-H—CO or NH—$SO_2$— and which together contain in all at least 8carbon atoms;

Y represents hydrogen, —OH, halogen; and

Z represents hydrogen or one or more substituents selected from halogen, alkyl, alkoxy, alkylthio, acylamino, alkylsulfonyl and sulfonyl, the substituents mentioned together containing in all no more than 5 carbon atoms.

2. A recording material as claimed in claim 1, wherein the colorless non-diffusing color coupler and the colored non-diffusing color coupler are associated with a green-sensitive silver halide emulsion layer unit.

3. A recording material as claimed in claims 1 or 2, wherein the non-diffusing colorless color coupler is a magenta coupler corresponding to one of general formulae III, IV and V:

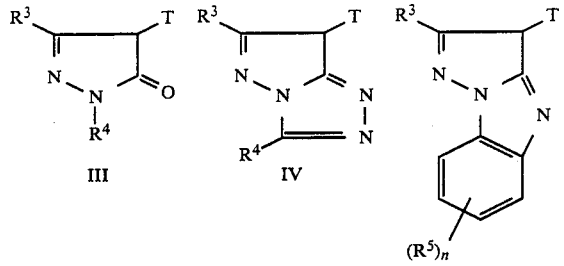

III IV V in which $R^3$ represents alkyl, aryl or an amino group, including a cyclic amino group, optionally substituted by alkyl, aryl or acyl;

$R^4$ represents alkyl, aralkyl or aryl;

$R^5$ represents halogen, alkyl, alkoxy, aroxy, amino, acylamino, carbamoyl, sulfamoyl, alkylsulfonyl;

n=1to 4;

T represents hydrogen or a group releasable during the color coupling reaction; at least one of the substituents T, $R^3$ and $R^4$ (or $R^5$) containing a ballast group.

4. A recording material as claimed in claim 1, wherein the colorless magenta coupler and the colored magenta coupler are associated with a silver halide emulsion layer unit consisting of at least two partial silver halide emulsion layers having different sensitivity, but the same spectral sensitivity.

5. A recording material as claimed in claim 4, wherein at least one partial silver halide emulsion layer of relatively high sensitivity or a non-photosensitive intermediate layer arranged between a partial silver halide emulsion layer of relatively high sensitivity and a less sensitive partial silver halide emulsion layer of a green-sensitive silver halide emulsion layer unit contains a non-diffusing colorless magenta coupler and a non-diffusing colored magenta coupler corresponding to the following general formula

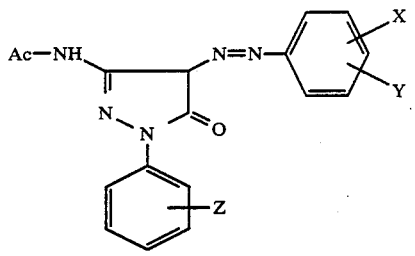

in which

Ac represents an acyl group containing in all at most 9 carbon atoms which does not contain an alkali-solubilizing group, the acyl group being derived from an aliphatic or aromatic carboxylic or sulfonic acid, a carbamic acid or a carbonic acid monoester;

X represents one, two or three alkyl groups which are attached directly or through —O—, —S—, —NH—CO— or NH—$SO_2$— and which together contain in all at least 8 carbon atoms;

Y represents hydrogen, —OH, halogen; and

Z represents hydrogen or one or more substituents selected from halogen, alkyl, alkoxy, alkylthio, acylamino, alkylsulfonyl and sulfonyl, the substituents mentioned together containing in all no more than 5 carbon atoms.

6. A recording material as claimed in claim 5, wherein the colored magenta coupler is present in all partial silver halide emulsion layers of a green-sensitive silver halide emulsion layer unit and all non-photosensitive intermediate layers arranged in between.

7. A color photographic recording material comprising at least one silver halide emulsion layer unit and at least two non-diffusing magenta color couplers, one colorless and the other colored, associated with the silver halide emulsion layer unit, wherein the colored non-diffusing color coupler contains, attached to the coupling position, a diffusion-proofing primary ballast group attached through an azo group and being releasable during the color coupling reaction and optionally, in non-coupling positions, one or more secondary ballast groups so that a hydrophobic dye of limited mobility is formed in the color coupling reaction, wherein the colored color coupler is a magenta coupler corresponding to the following formula

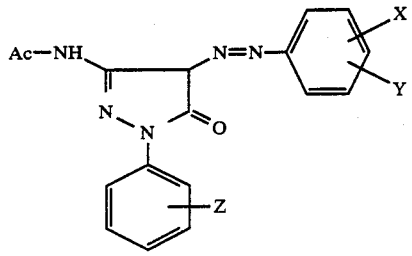

in which

Ac is a acyl group containing in all at most 9 carbon atoms which does not contain an alkali-solubilizing group, the acyl group being derived from an aliphatic or aromatic carboxylic or sulfonic acid, a carbamic acid or a carbonic acid monoester;

X represents one, two or three alkyl groups which are attached directly or through —O—, —S—, —NH—CO or NH—$SO_2$— and which together contain in all at least 8 carbon atoms;

Y represents hydrogen, —OH, halogen; and

Z represents hydrogen or one or more substituents selected from halogen, alkyl, alkoxy, alkythio, acylamino, alkylsulfonyl and sulfonyl, the substituents mentioned together containing in all no more than 5 carbon atoms;

wherein the non-diffusing colorless color coupler is a magenta coupler corresponding to one of general formulae IV or V:

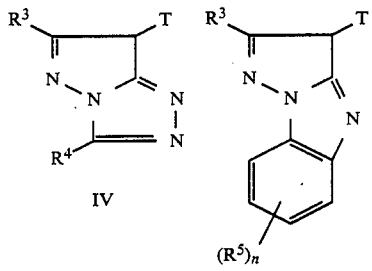

IV V in which $R^3$ represents alkyl, aryl or an amino group, including a cyclic amino group, optionally substituted by alkyl, aryl or acyl;

$R^4$ represents alkyl, aralkyl or aryl;

$R^5$ represents halogen, alkyl, alkoxy, aroxy, amino, acylamino, carbamoyl, sulfamoyl, alkylsulfonyl;

n=1 to 4;

T represents hydrogen or a group releasable during the color coupling reaction; at least one of the substituents T, $R^3$ and $R^4$ (or $R^5$) containing a ballast group; and wherein the amount of the colored magenta color coupler is 21.8 to 25.2 mole percent based on the amount of all couplers in said layer.

* * * * *